US006907697B2

(12) United States Patent
Gergely et al.

(10) Patent No.: US 6,907,697 B2
(45) Date of Patent: Jun. 21, 2005

(54) COMPOSITE SYSTEMS AND METHODS FOR ANCHORING WALLS

(75) Inventors: Janos Gergely, UNC Charlotte, NC (US); David T. Young, UNC Charlotte, NC (US)

(73) Assignee: The University of North Carolina at Charlotte, Charlotte, NC (US)

( * ) Notice: Subject to any disclaimer, the term of this patent is extended or adjusted under 35 U.S.C. 154(b) by 276 days.

(21) Appl. No.: 09/916,004

(22) Filed: Jul. 26, 2001

(65) Prior Publication Data

US 2002/0056249 A1 May 16, 2002

Related U.S. Application Data

(60) Provisional application No. 60/244,301, filed on Oct. 31, 2000.

(51) Int. Cl.[7] ..... E02D 27/00

(52) U.S. Cl. ..... 52/293.3; 52/295; 52/298; 52/698; 52/703

(58) Field of Search ..... 52/292, 293.1, 52/293.2, 293.3, 295, 298, 698, 700, 703

(56) References Cited

U.S. PATENT DOCUMENTS

| | | | | | |
|---|---|---|---|---|---|
| 3,867,804 | A | * | 2/1975 | Wilson | 52/699 |
| 4,315,391 | A | * | 2/1982 | Piazza | 52/293.2 |
| 4,783,935 | A | * | 11/1988 | Creager | 264/31 |
| 4,903,450 | A | * | 2/1990 | Adams | 52/293.2 |
| 5,685,115 | A | * | 11/1997 | Colfer | 52/292 |
| 5,836,132 | A | * | 11/1998 | Weathersby | 249/205 |
| 5,979,123 | A | * | 11/1999 | Brockman | 119/61 |
| 6,003,276 | A | * | 12/1999 | Hegemier et al. | 52/273 |
| 6,018,917 | A | * | 2/2000 | Leek | 156/423 |
| 6,067,769 | A | * | 5/2000 | Hardy | 52/295 |
| 6,105,332 | A | * | 8/2000 | Boyadjian | 411/466 |
| 6,138,421 | A | | 10/2000 | Grigsby | 52/293.2 |
| 6,141,937 | A | * | 11/2000 | Dressler | 52/298 |
| 6,145,260 | A | * | 11/2000 | Morton | 52/293.2 |
| 6,176,055 | B1 | * | 1/2001 | Fu | 52/167.7 |
| 6,216,403 | B1 | * | 4/2001 | Belbeoc'h | 52/223.13 |
| 6,244,005 | B1 | * | 6/2001 | Wallin | 249/19 |
| 6,393,795 | B1 | * | 5/2002 | Irwin et al. | 411/82.1 |
| 6,431,797 | B2 | * | 8/2002 | Greenberg | 405/262 |

FOREIGN PATENT DOCUMENTS

| | | | | |
|---|---|---|---|---|
| EP | 0487422 | * | 11/1991 | E04B/1/41 |
| JP | 6-294137 | * | 4/1993 | E02D/27/34 |
| JP | 6-220925 | * | 8/1994 | E04B/1/64 |

OTHER PUBLICATIONS

Canadian Journal of Civil Engineering, Article , Nov. 29, 1991, O. Chaallal and B. Benmokrane.*

* cited by examiner

*Primary Examiner*—Carl D. Friedman
*Assistant Examiner*—Chi Q Nguyen
(74) *Attorney, Agent, or Firm*—Kilpatrick Stockton LLP

(57) ABSTRACT

Construction systems and methods for anchoring a structural member of a building to a base member of a building including one or more anchoring devices, each anchoring device having a first portion and a second portion. The first portion of each anchoring device is fixedly attached to the structural member and the second portion of each anchoring device is fixedly attached to the base member. Each anchoring device preferably including a fiber composite material.

42 Claims, 6 Drawing Sheets

COMPOSITE SYSTEMS AND METHODS FOR ANCHORING WALLS

CROSS-REFERENCE TO RELATED APPLICATIONS

This application claims the benefit of U.S. Provisional Patent Application No. 60/244,301, filed Oct. 31, 2000.

BACKGROUND OF THE INVENTION

The present invention relates generally to construction systems and methods for use in new and existing structures and, more specifically, to composite systems and methods for anchoring walls to footings, foundations, roofs, and slabs.

In new construction and retrofit and repair applications it is often necessary to strengthen or reinforce masonry, concrete, and timber walls such that they are capable of withstanding flexural loads caused by, for example, the wind or seismic activity. It is also often necessary to strengthen or reinforce the positive connection between such walls and footings or slabs, enabling the walls to withstand and transfer shear loads as well. Masonry, concrete, and timber walls are typically strengthened using steel reinforcing members, such as reinforcing bar ("rebar"). For example, rebar may be inserted into the cavities of the concrete masonry units ("CMUs" or "cinder blocks") of a masonry wall, or in the collar joints of a brick structure. The CMU cores may then be filled with grout. The rebar may extend vertically downward and mate with dowel holes drilled in the footing or it may extend vertically upward and mate with dowel holes drilled in the slab. Although marginally effective, in retrofit and repair applications these systems and methods may require the face shells of the CMUs to be temporarily removed. Thus, such systems and methods may be obtrusive, labor-intensive, and expensive.

More desirable systems and methods for strengthening or reinforcing masonry, concrete, and timber walls involve the use of high-strength composite materials. The flexural and shear load capability of a wall may be increased by adhering a thin composite fiber sheet or laminate impregnated with an epoxy resin or polymer to its surface. Typical composite laminates include glass, carbon, or aramid fibers. Such composite materials are 5 to 10 times stronger per unit weight than comparable traditional materials. These systems and methods, however, do little to increase the strength of the connection between a wall and a footing, foundation, floor, roof, or slab because they do not interface the wall with its supporting structure. Thus, what is needed are systems and methods utilizing composites for strengthening and reinforcing the positive connection between reinforced or unreinforced walls and footings or slabs. Further, what is needed are systems and methods that are unobtrusive, relatively simple to implement, and inexpensive.

BRIEF SUMMARY OF THE INVENTION

The present invention provides composite systems and methods for strengthening and reinforcing the positive connection between reinforced or unreinforced walls and footings or slabs. These systems and methods may be utilized in new construction and retrofit and repair applications.

In one embodiment, a construction system for anchoring a structural member of a building to a base member of a building includes one or more anchoring devices, each anchoring device having a first portion and a second portion, the first portion of each anchoring device fixedly attached to the structural member and the second portion of each anchoring device fixedly attached to the bas e member. Each anchoring device preferably includes a fiber composite material.

In another embodiment, a construction system for anchoring a structural member of a building to a base member of a building includes a structural member comprising one of a reinforced wall and an unreinforced wall; a base member comprising a member selected from the group consisting of a footing, a foundation, a floor, a roof, and a slab; and one or more anchoring devices, each anchoring device having a first portion and a second portion, the first portion of each anchoring device fixedly attached to the structural member and the second portion of each anchoring device fixedly attached to the base member. Each anchoring device preferably includes a fiber composite material.

In a further embodiment, a construction method for anchoring a structural member of a building to a base member of a building includes fixedly attaching a first portion of a composite fiber anchor to the structural member and fixedly attaching a second portion of the composite fiber anchor to the base member. Each composite fiber anchor preferably has a sufficient strength to transfer a predetermined load from the structural member to the base member.

DETAILED DESCRIPTION OF THE INVENTION

Figure 1:
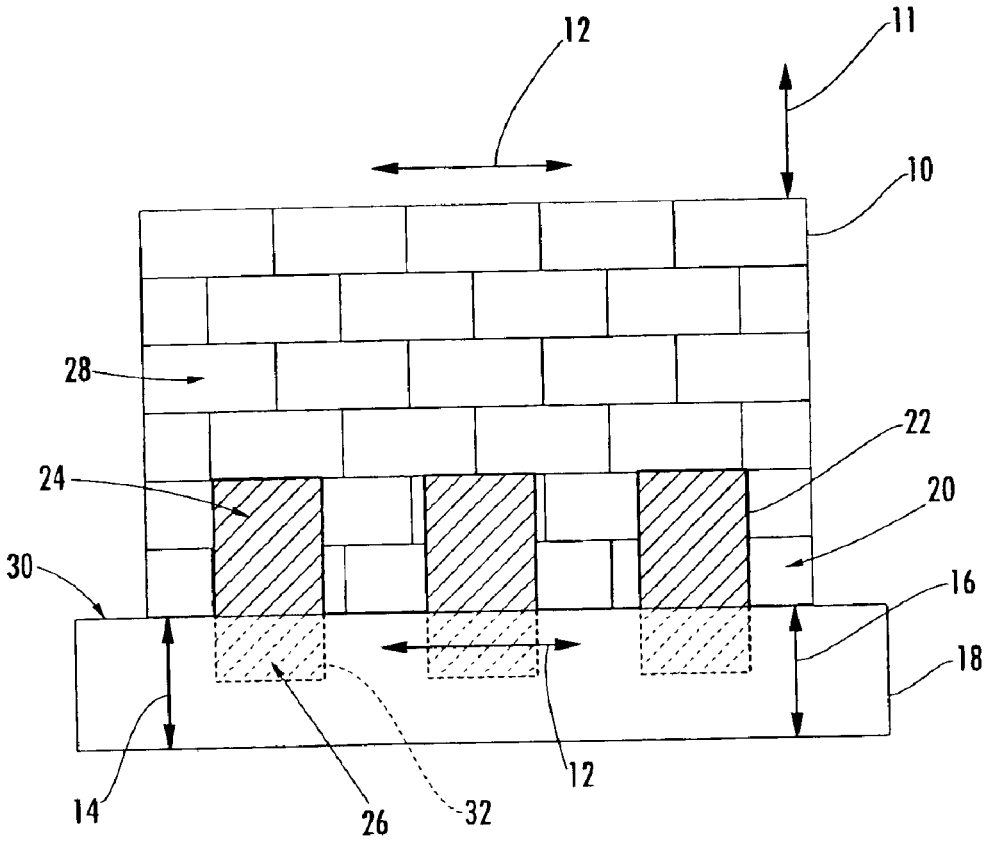
FIG. 1 is a front elevation view of a wall anchored to a footing or foundation using the composite wall anchoring system of the present invention.

A typical load-bearing wall used in residential or commercial construction may be made of a building material, such as a plurality of CMUs/cinder blocks, clay blocks, clay bricks, clay tiles, concrete, prefabricated or modular panels, or it may be framed using wood or the like. Such walls are used to transfer loads from a roof, slab, or beam to a footing or foundation. Referring to FIG. 1, a structural member 10, i.e. a wall, may be subjected to a variety of loads, including lateral loads, transverse loads, axial loads 11, flexural loads, shear loads 12, coupling loads (including tension loads 14 and compression loads 16), etc. These loads may be caused by, for example, the general structural configuration of a building, gravity, the wind, or seismic activity. Structural members 10 may initially be designed to withstand only limited predetermined loading conditions and in retrofit and repair applications, as well as in new construction, it is often necessary to strengthen or reinforce masonry, concrete, and timber walls such that they are capable of withstanding increased predetermined loading conditions. It may also be necessary to strengthen or reinforce the positive connection between such structural members 10 and a base member 18, such as a footing, foundation, roof, or slab, enabling the walls to withstand increased loads, such as shear loads 12, tension loads 14, and compression loads 16. As such, the base member 18 provides a support capable of withstanding the given predetermined loading conditions. As discussed above, masonry walls, such as those typically used in commercial structures, are often strengthened or reinforced using rebar. More desirable systems and methods, however, involve the use of high-strength composite materials. The flexural load capability of a structural member 10 may be increased by adhering a thin composite fiber sheet or laminate impregnated with an epoxy resin or polymer to its surface 28. Typical composite laminates include glass, carbon, or aramid fiber composites. These systems and methods, however, do little to increase the shear load transfer between a structural member 10 and a base member 18.

In one embodiment, the composite wall anchoring system 20 of the present invention includes one or more anchoring devices 22, each anchoring device 22 including a first portion 24 fixedly attached to a structural member 10 and a second portion 26 fixedly attached to a base member 18, such as the footing, foundation, roof, or slab of a structure. Each anchoring device 22 preferably includes a composite member, such as a thin, flexible, uncured composite sheet or laminate, or a rigid, preformed plate. Each composite sheet or laminate may be as thin as about 0.023 in., although other thicknesses may be utilized. The fibers of the composite sheet or laminate may be aligned such that the sheet or laminate is able to withstand predetermined loading conditions along or around a given axis of the structural member 10. Multiple composite layers may be utilized, and the orientation of each layer may be varied. The composite laminate anchors 22 may be attached to the structural member 10 and base member 18 by means of mechanical fasteners or a bonding mechanism/adhesive, such as an epoxy resin or a polymer. The bonding mechanism is preferably a strucutural adhesive of sufficient viscosity to allow it to be used to fill a channel or groove. The composite laminate anchors 22 may be attached to a reinforced or unreinforced structural member 10. For example, the structural member 10 may be reinforced with rebar or an existing composite sheet or laminate adhered to its surface 28. Thus, one or more anchoring devices 22 form a composite fiber anchoring system 20 having a sufficient strength to transfer predetermined loads from a structural member 10 to a base member 18.

Each composite laminate anchor 22 may be attached to and cover a portion of the surface 28 of the structural member 10, vertically and/or horizontally. Alternatively, a single composite laminate anchor 22 may be attached to and cover the entire surface 28 of the structural member 10, vertically and/or horizontally. For example, as shown in FIG. 1, a plurality of composite laminate anchors 22 may be utilized such that the first portion 24 of each extends partially or entirely up the surface 28 of the structural member 10 and the second portion 26 of each is fixedly attached to a surface 30 of the base member 18 or disposed within a groove 32 located in the base member 18. Alternatively, a single composite laminate anchor 22 may be used such that the first portion 24 of the anchor 22 extends partially or entirely up the surface 28 of the structural member 10 and the second portion 26 of the anchor 22 is fixedly attached to a surface 30 of the base member 18 or disposed within a groove 32 located in the base member 18. Composite laminate anchors 22 may also be utilized on more than one surface of the structural member 10.

Figure 2:
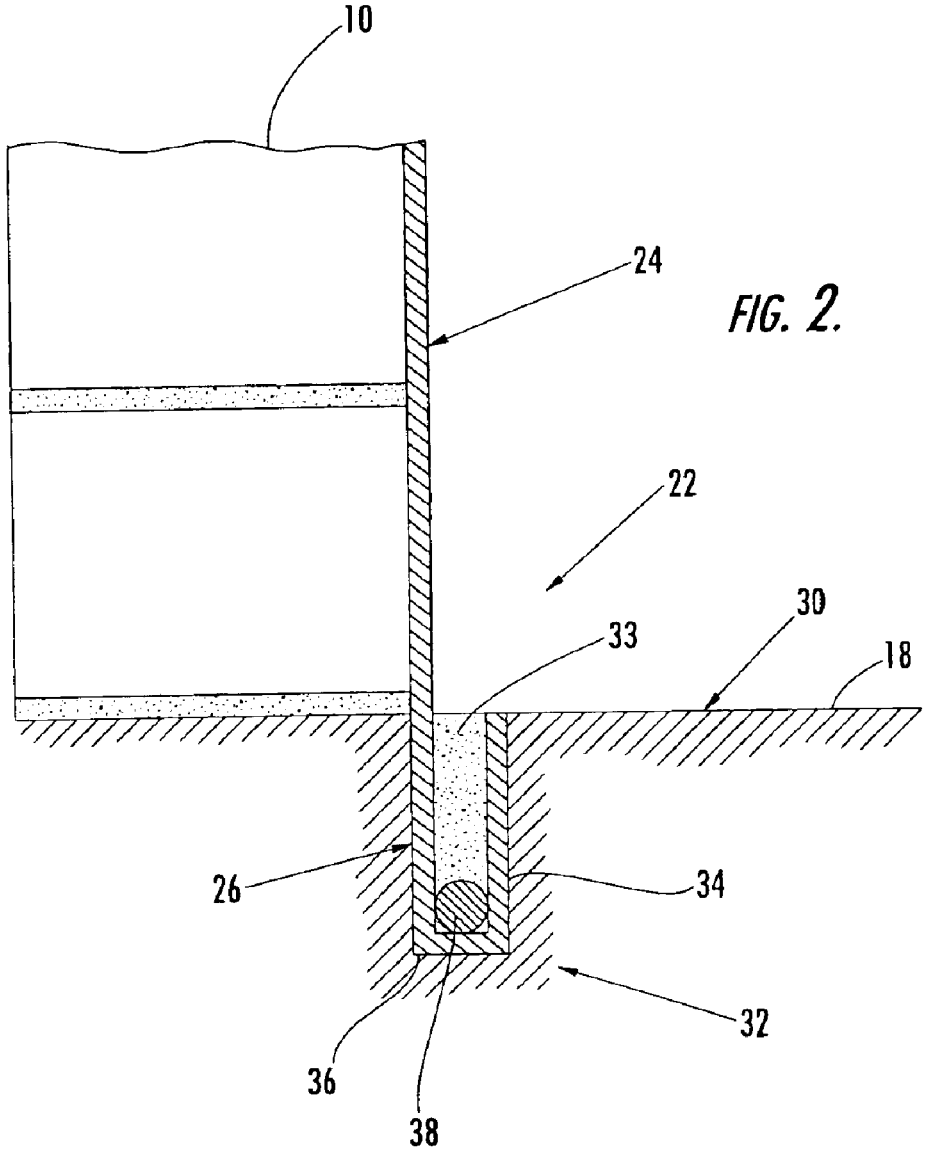
FIG. 2 is a cross-sectional side view of one embodiment of the composite wall anchoring system of the present invention, utilizing an elongated clamping/wedging member.

Referring to FIG. 2, in one embodiment, the first portion 24 of the composite laminate anchor 22 may be fixedly attached to the structural member 10, such as by using an adhesive. The second portion 26 of the composite laminate anchor 22 may be disposed and fixedly attached within a groove 32 cut into or integrally formed within the base member 18. The groove 32 preferably has two substantially parallel vertically-extending side portions 34 and a horizontally-extending bottom portion 36. The groove 32 may be, for example, about 0.50 in. to about 1.50 in. wide and about 2.00 in. to about 5.00 in. deep and, more preferably, about 0.75 in. to about 1 in. wide and about 3.50 in. to about 4.00 in. deep. It should be noted, however, that a groove 32 with other dimensions may be utilized. The groove 32 may also have a predetermined longitudinal or lateral measurement. The groove 32 may be formed using, for example, a saw or an angle grinder with a diamond blade. Preferably, the groove 32 is formed such that it is adjacent to and in line with the surface 28 of the structural member 10. The second portion 26 of the composite laminate anchor 22 may be disposed within the groove 32 and contacted with an adhesive such that it is fixedly attached to the two vertically-extending side portions 34 and the horizontally-extending bottom portion 36. The adhesive may further fill the spaced-apart region between the side portions 34. Optionally, an elongated member 38, such as a predetermined length of rebar, a cured composite rod, or the like, may be disposed within the groove 32. The elongated member 38 is preferably made of a material that is compatible with the material comprising the composite laminate anchor 22, minimizing corrosion, maximizing adhesion, etc. The elongated member 38 is sized to provide a clamping or wedging force, securing the second portion 26 of the composite laminate anchor 22 within the groove 32. The groove 32 may be filled with a filling compound 33, such as grout or the like, and made flush with the surface 30 of the base member 18. It should be noted that this and all embodiments may be used to anchor structural members to roofs and slabs, as well as footings, foundations, and floors.

The first portion 24 and second portion 26 of each composite laminate anchor 22, and especially the second portion 26 in contact with the base member 18, are sized such that each anchoring device 22 is able to withstand all of a predetermined portion of the predetermined load associated with a given structural member 10 or structure.

Figure 3:
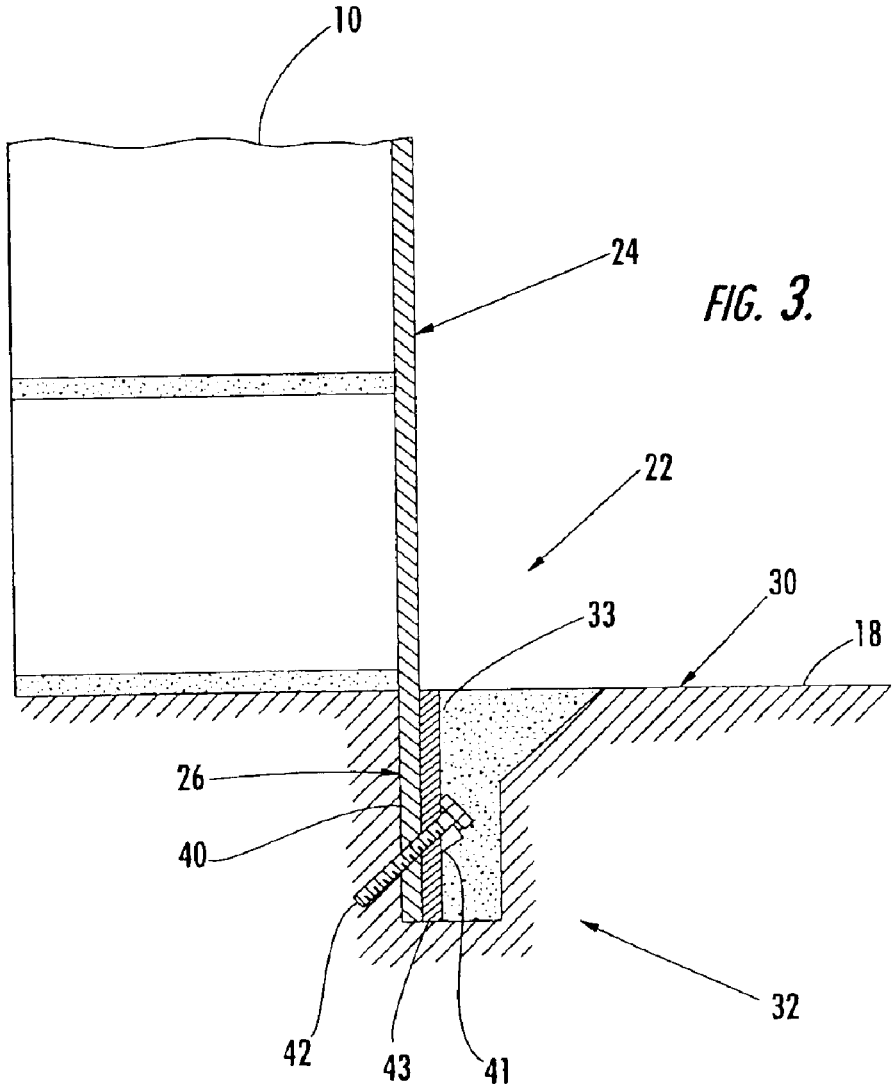
FIG. 3 is a cross-sectional side view of another embodiment of the composite wall anchoring system of the present invention.

Referring to FIG. 3, in a related embodiment, the first portion 24 of the composite laminate anchor 22 may be fixedly attached to the structural member 10 using a bonding mechanism/adhesive. The second portion 26 of the composite laminate anchor 22 may be disposed within a groove 32 cut into or integrally formed within the base member 18. The second portion 26 of the composite laminate anchor 22 may be contacted or impregnated with an adhesive and disposed within the groove 32 such that it is fixedly attached to the vertically-extending side portion 40 directly adjacent to the structural member 10. Optionally, a mechanical fastener 42, such as a bolt or a pin, may be inserted through a washer member 41, a securing member 43, the second portion 26 of the composite laminate anchor 22, and the base member 18, securing the second portion 26 of the composite laminate anchor 22 within the groove 32. The securing member 43 may be, for example, a non-ferrous plate when a carbon composite laminate anchor 22 is used. The groove 32 may be filled with a filling compound 33, such as grout or the like, and made flush with the surface 30 of the base member 18.

Figure 4:
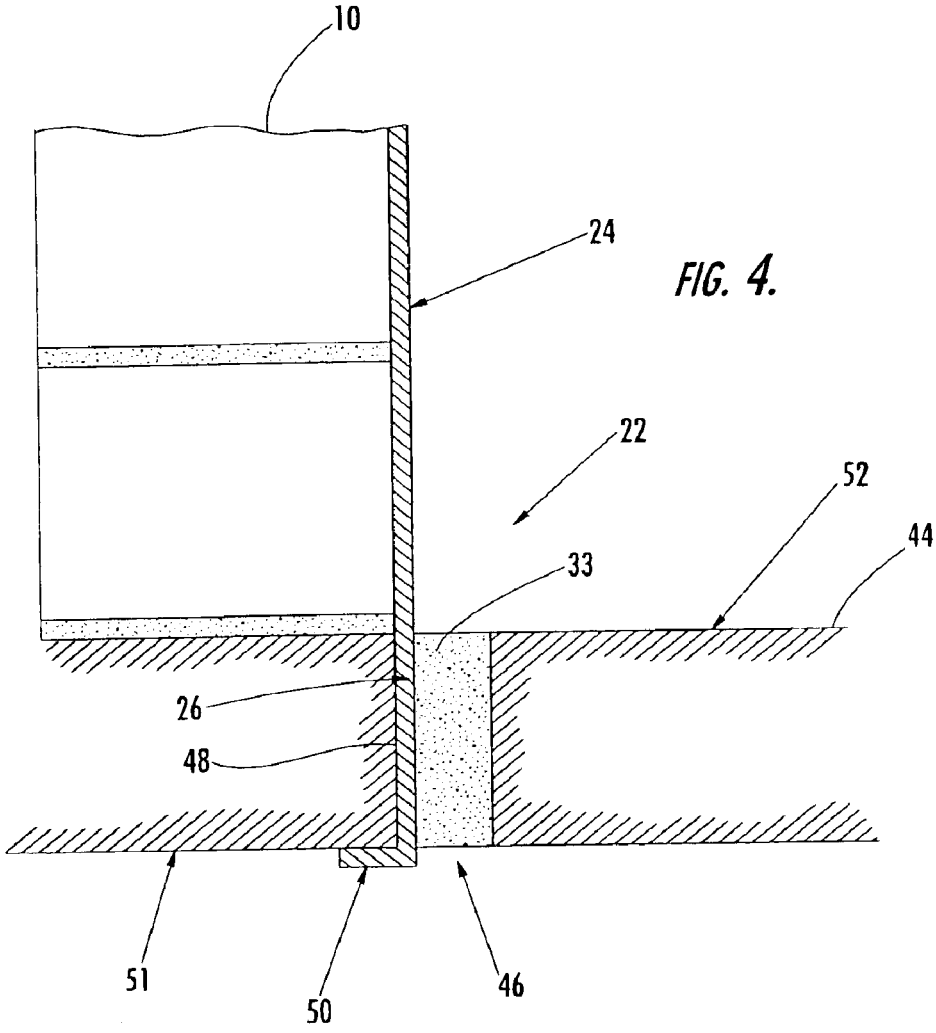
FIG. 4 is a cross-sectional side view of one embodiment of the composite wall anchoring system of the present invention, as applied to a floor or a slab.

Referring to FIG. 4, in an embodiment typically involving a floor or a slab 44, the first portion 24 of the composite laminate anchor 22 may be fixedly attached to the structural member 10 using a bonding mechanism/adhesive. The second portion 26 of the composite laminate anchor 22 may be disposed within a channel 46 cut into or integrally formed within the slab 44. The second portion 26 of the composite laminate anchor 22 may be contacted or impregnated with an adhesive and disposed within the channel 46 such that it is fixedly attached to a vertically-extending side portion 48 of the channel 46 directly adjacent to the structural member 10. Optionally, a third, horizontally-extending portion 50 of the composite laminate anchor 22 may be fixedly attached to the lower surface 51 of the slab 44. The channel 46 may be filled with a filling compound 33, such as grout or the like, and made flush with the upper surface 52 and the lower surface 51 of the slab 44.

Figure 5:
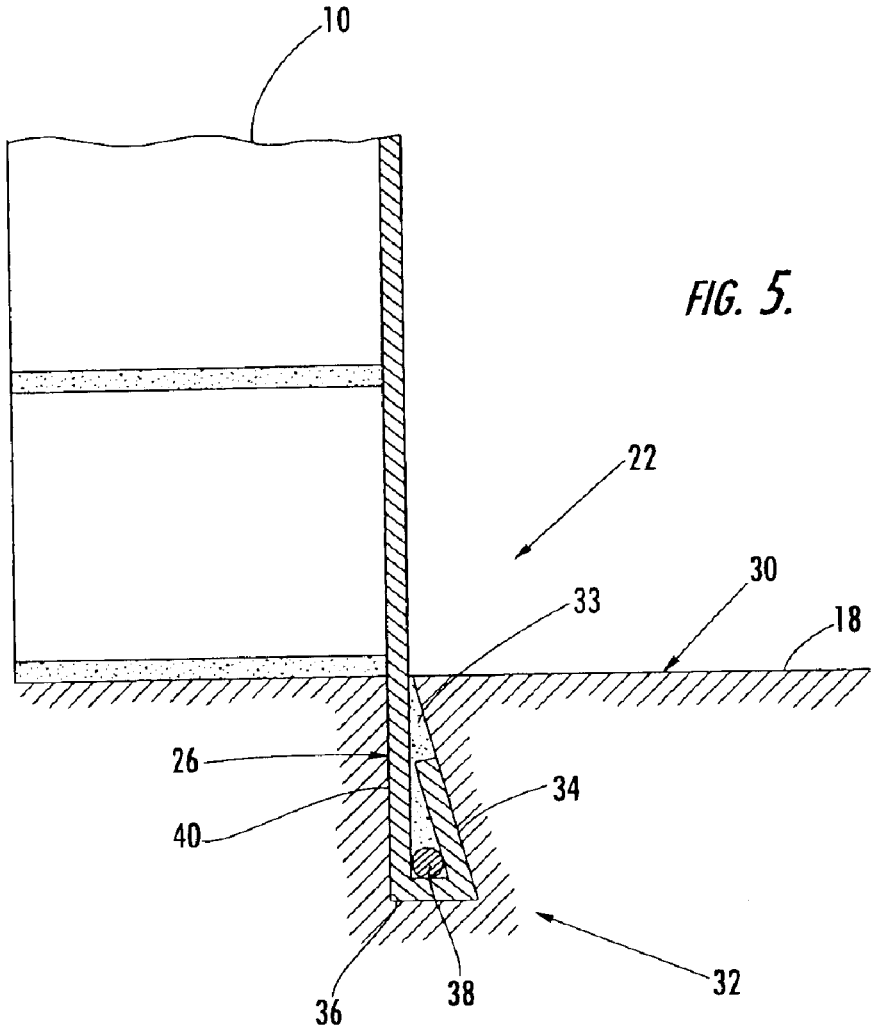
FIG. 5 is a cross-sectional side view of another embodiment of the composite wall anchoring system of the present invention, utilizing a wedge-shaped groove and an elongated clamping/wedging member.

Referring to FIG. 5, in another embodiment, the groove 32 cut into or integrally formed within the base member 18 may have two vertically-extending side portions 34 and a horizontally-extending bottom portion 36 that form a wedge shape having a predetermined lateral measurement. The second portion 26 of the composite laminate anchor 22 may be contacted or impregnated with a bonding mechanism/adhesive and disposed within the groove 32 such that it is fixedly attached to the vertically-extending side portion 40 directly adjacent to the structural member 10. Optionally, an elongated member 38, such as a predetermined length of rebar, a cured composite rod, or the like, may be disposed within the wedge-shaped groove 32. The elongated member 38 provides a clamping or wedging force, securing the second portion 26 of the composite laminate anchor 22 within the groove 32. The groove 32 may be filled with a filling compound 33, such as grout or the like, and made flush with the surface 30 of the base member 18.

In a similar embodiment, the groove 32 cut into or integrally formed within the base member 18 may have three substantially parallel vertically-extending side portions, a horizontally-extending bottom portion, and a horizontally-extending top portion which form a partially enclosed channel. The second portion 26 of the composite laminate anchor 22 may be shaped or formed such that it has a hook portion on its end, the hook portion suitable for engaging the partially enclosed channel. The second portion 26 of the composite laminate anchor 22 may be contacted or impregnated with a bonding mechanism/adhesive and disposed within the groove 32 such that it is fixedly attached to the two vertically-extending side portions and the horizontally-extending bottom portion. The groove 32 may be filled with a filling compound 33, such as grout or the like, and made flush with the surface 30 of the base member 18.

Figure 6:
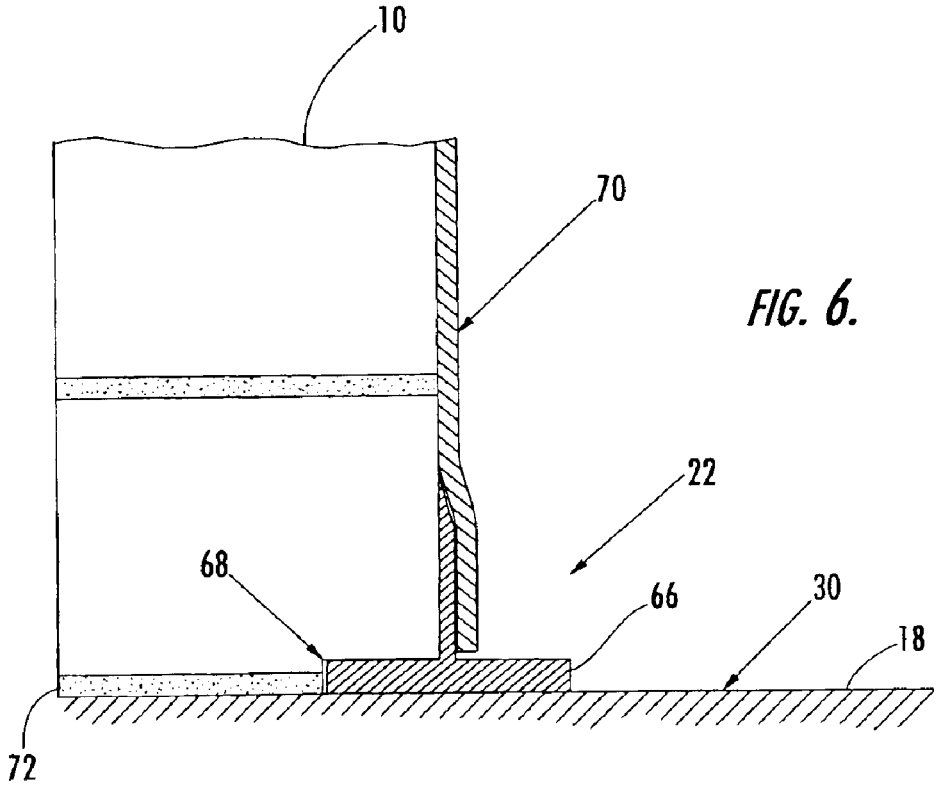
FIG. 6 is a cross-sectional side view of a final embodiment of the composite wall anchoring system of the present invention, utilizing a T-shaped member.

Referring to FIG. 6, in a further embodiment, the composite laminate anchor 22 may include a T-shaped member 66 which is partially disposed within a groove 68 cut into or integrally formed within the structural member 10 directly adjacent to the base member 18. The T-shaped member 66 is preferably made of a rigid, preformed composite material and may be, for example, a fiber-reinforced polymer (FRP) pultruded T-shape. Both the T-shaped member 66 and the groove 68 may have a predetermined lateral measurement. The T-shaped member 66 may be fixedly attached or bonded to the surface 30 of the base member 18 or floor using an adhesive. The T-shaped member 66 may also be fixedly attached to the structural member 10 using an adhesive. A composite sheet or laminate 70 may be fixedly attached to the structural member 10 and the T-shaped member 66 using an adhesive. This embodiment is advantageous because the groove 68 may be cut or formed into the bottom mortar joint 72 of the structural member 10, maximizing simplicity and minimizing expense. The groove 68 may also increase the composite laminate anchor's uplift and shear load capacity by utilizing the weight of the structure.

In each of the above embodiments, all surfaces to which a composite laminate anchor 22 is attached, including the surface of a structural member, a footing, a foundation, a floor, a roof, or a slab, are preferably cleaned and primed prior to the application of an epoxy resin or polymer adhesive. After a composite laminate anchor 22 is fixedly attached to a surface, a groove, or a channel, the composite laminate anchor 22 may be trimmed as necessary.

It is apparent that there have been provided, in accordance with the present invention, systems and methods for anchoring reinforced and unreinforced walls to footings, foundations, floors, roofs, and slabs using composite materials. The present invention permits masonry (including concrete masonry unit (CMU), concrete brick, clay brick, clay block, and clay tile), concrete, and timber walls, and the positive connection between such walls and other structural members, to be reinforced or strengthened such that they are capable of withstanding predetermined flexural loads, shear loads, axial loads, lateral loads, and coupling loads (including tension loads and compression loads). While the present invention has been particularly shown and described in conjunction with preferred embodiments thereof, it will be appreciated that variations in and modifications to the present invention may be effected by persons of ordinary skill in the art without departing from the spirit or scope of the present invention. For example, the type of composite material, the number and orientation of fiber layers, the thickness of the composite material, the dimensions of the first and second anchor portions, and the type of affixing mechanism may all vary depending upon the given materials involved, the environmental conditions, and the predetermined loading conditions. Further, it is to be understood that the principles related to composite fiber systems and methods for anchoring reinforced and unreinforced walls described herein apply in a similar manner, where applicable, to all preferred embodiments.

What is claimed is:

1. A construction system for anchoring a structural member of a building to a base member of a building, the system comprising:

an anchoring device comprising a first portion and a second portion, the first portion of the anchoring device fixedly attached to the structural member and the second portion of the anchoring device fixedly attached to the base member; and wherein the anchoring device comprises a fiber composite material, the fiber composite material comprising one of an uncured sheet, an uncured laminate, and a plate.

2. The system of claim 1, wherein the first portion of the anchoring device is fixedly attached to the structural member using a bonding mechanism.

3. The system of claim 1, wherein the second portion of the anchoring device is fixedly attached to the base member using a bonding mechanism.

4. A construction system for anchoring a structural member of a building to a base member of a building, the system comprising:

an anchoring device comprising a first portion and a second portion, the first portion of the anchoring device fixedly attached to the structural member and the second portion of the anchoring device fixedly attached to the base member; and wherein the anchoring device comprises a fiber composite material, the base member further comprising an internal wall defining a groove, and the second portion of the anchoring device at least partially disposed within the groove.

5. A construction system for anchoring a structural member of a building to a base member of a building, the system comprising:

an anchoring device comprising a first portion and a second portion, the first portion of the anchoring device fixedly attached to the structural member and the second portion of the anchoring device fixedly attached to the base member; and wherein the anchoring device comprises a fiber composite material the base member further comprising an internal wall defining a groove, the second portion of the anchoring device at least partially disposed within the groove, and the internal wall defining a groove in the base member adjacent to and in line with a surface of the structural member.

6. A construction system for anchoring a structural member of a building to a base member of a building, the system comprising:

an anchoring device comprising a first portion and a second portion, the first portion of the anchoring device fixedly attached to the structural member and the second portion of the anchoring device fixedly attached to the base member; and wherein the anchoring device comprises a fiber composite material, the base member further comprising an internal wall defining a groove, the second portion of the anchoring device at least partially disposed within the groove, and the internal wall defining a groove in the base member adjacent to and in line with a surface of the structural member, and an elongated member disposed within the groove adapted to clamp or wedge the second portion of the anchoring device in the groove of the base member.

7. The system of claim 4, wherein the anchoring device comprises an angle member comprising a first portion and a second portion, the first portion of the angle member substantially perpendicular to the second portion of the angle member.

8. The system of claim 4, wherein the second portion of the anchoring device is adapted to withstand a predetermined load.

9. The system of claim 4, wherein the anchoring device is adapted to transfer a predetermined load from the structural member to the base member.

10. A system comprising:

a structural member comprising one of a reinforced wall and an unreinforced wall;

a base member comprising one of a footing, a foundation, a floor, a roof, and a slab; and an anchoring device comprising a first portion and a second portion, the first portion of the anchoring device fixedly attached to the structural member and the second portion of the anchoring device fixedly attached to the base member, wherein the anchoring device comprises a fiber composite material, the fiber composite material comprising one of an uncured sheet, a flexible, uncured laminate, and a rigid preformed plate.

11. The system of claim 10, wherein the first portion of the anchoring device is fixedly attached to the structural member using a bonding mechanism.

12. The system of claim 10, wherein the second portion of the anchoring device is fixedly attached to the base member using a bonding mechanism.

13. A system comprising:

a structural member comprising one of a reinforced wall and an unreinforced wall;

a base member comprising an internal wall defining a groove; and an anchoring device comprising a first portion and a second portion, the first portion of the anchoring device fixedly attached to the structural member and the second portion of the anchoring device fixedly attached to the base member, wherein the anchoring device comprises a filer composite material, the second portion of the anchoring device at least partially disposed within the groove.

14. A system comprising:

a structural member comprising one of a reinforced wall and an unreinforced wall;

a base member comprising an internal wall defining a groove, the internal wall disposed adjacent to and substantially aligned with a surface of the structural member; and an anchoring device comprising a first portion and a second portion, the first portion of the anchoring device fixedly attached to the structural member and the second portion of the anchoring device fixedly attached to the base member, wherein the anchoring device comprises a fiber composite material, the second portion of the anchoring device at least partially disposed within the groove.

15. A system comprising:

a structural member comprising one of a reinforced wall and an unreinforced wall;

a base member comprising an internal wall defining a groove;

an anchoring device comprising a first portion and a second portion, the first portion of the anchoring device fixedly attached to the structural member and the second portion of the anchoring device fixedly attached to the base member, wherein the anchoring device comprises a fiber composite material, the second portion of the anchoring device at least partially disposed within the groove; and an elongated member disposed within the groove adapted to clamp or wedge the second portion of the anchoring device in the groove of the base member.

16. The system of claim 10, wherein the anchoring device comprises an angle member comprising a first portion and a second portion, the first portion of the angle member substantially perpendicular to the second portion of the angle member.

17. A method comprising:

fixedly attaching a first portion of a composite fiber anchor to a structural member;

fixedly attaching a second portion of the composite fiber anchor to a base member, the composite fiber anchor adapted to transfer a predetermined load from the structural member to the base member; and forming a groove in the base member; and disposing the second portion of the composite fiber anchor at least partially in the groove.

18. A method comprising:

fixedly attaching a first portion of a composite fiber anchor to a structural member;

fixedly attaching a second portion of the composite fiber anchor to a base member, the composite fiber anchor adapted to transfer a predetermined load from the structural member to the base member;

forming a groove in the base member;

disposing the second portion of the composite fiber anchor at least partially in the groove; and positioning a wall of the groove substantially in line with a surface of the structural member.

19. A method comprising:

fixedly attaching a first portion of a composite fiber anchor to a structural member;

fixedly attaching a second portion of the composite fiber anchor to a base member, the composite fiber anchor adapted to transfer a predetermined load from the structural member to the base member;

forming a groove between the structural member and the base member; and disposing the second portion of the composite fiber anchor at least partially in the groove.

20. The method of claim 17, wherein fixedly attaching the first portion of the composite fiber anchor to the structural member and the second portion of the composite fiber anchor to the base member comprises bonding the first portion of the composite fiber anchor to the structural member and the second portion of the composite fiber anchor to the base member.

21. The method of claim 17, wherein fixedly attaching the first portion of the composite fiber anchor to the structural member and the second portion of the composite fiber anchor to the base member comprises mechanically fastening the first portion of the composite fiber anchor to the structural member and the second portion of the composite fiber anchor to the base member.

22. The method of claim 17, wherein fixedly attaching the second portion of the composite fiber anchor to the base member comprises sizing the second portion of the composite fiber anchor sufficient to withstand a predetermined load.

23. The method of claim 17, wherein the structural member comprises one of a reinforced wall and an unreinforced wall.

24. The method of claim 17, wherein the base member comprises one of a footing, a foundation, a floor, a roof, and a slab.

25. The system claim 1, wherein the structural member comprises one of a reinforced wall and an unreinforced wall.

26. The system of claim 1, wherein the base member comprises one of a footing, a foundation, a floor, a roof, and a slab.

27. The system of claim 1, wherein the base member comprises an internal wall defining a groove, the second portion of each anchoring device at least partially disposed within the groove.

28. The system of claim 27, wherein the internal wall is adjacent to a surface of the structural member.

29. The system of claim 27, wherein the internal wall is aligned substantially with a surface of the structural member.

30. The system of claim 27, further comprising an elongated member disposed within the groove, the elongated member adapted to clamp or wedge the second portion of the anchoring device disposed in the groove of the base member.

31. The system of claim 1, wherein the anchoring device comprises an angle member comprising a first portion and a second portion, the first portion of the angle member substantially perpendicular to the second portion of the angle member.

32. The system of claim 1, wherein the second portion of the anchoring device is adapted to withstand a predetermined load.

33. The system of claim 1, wherein the anchoring device is adapted to transfer a predetermined load from the structural member to the base member.

34. The system of claim 4, wherein the structural member comprises one of a reinforced wall and an unreinforced wall.

35. The system of claim 4, wherein the base member comprises one of a footing, a foundation, a floor, a roof, and a slab.

36. The system of claim 4, wherein the fiber composite material comprises one of an uncured sheet, an uncured laminate, and a plate.

37. The system of claim 4, wherein the first portion of the anchoring device is fixedly attached to the structural member using a bonding mechanism.

38. The system of claim 4, wherein the second portion of the anchoring device is fixedly attached to the base member using a bonding mechanism.

39. The system of claim 10, wherein the base member comprises an internal wall defining a groove, the second portion of the anchoring device at least partially disposed within the groove.

40. The system of claim 39, wherein the internal wall is adjacent to a surface of the structural member.

41. The system of claim 39, wherein the internal wall is aligned substantially with a surface of the structural member.

42. The system of claim 39, further comprising an elongated member disposed within the groove adapted to clamp or wedge the second portion of the anchoring device in the groove of the base member.

* * * * *